US005355596A

United States Patent [19]

Sussmann

[11] Patent Number: 5,355,596

[45] Date of Patent: Oct. 18, 1994

[54] SHOE WITH A CENTRAL CLOSURE

[75] Inventor: Reinhold Sussmann, Scheinfeld, Fed. Rep. of Germany

[73] Assignee: Tretorn AB, Helsingborg, Sweden

[21] Appl. No.: 113,659

[22] Filed: Aug. 31, 1993

[30] Foreign Application Priority Data

Aug. 31, 1992 [DE] Fed. Rep. of Germany ... 9211711[U]

[51] Int. Cl.[5] ..... A43B 11/00

[52] U.S. Cl. ..... 36/50.1; 36/54; 36/45

[58] Field of Search ..... 36/45, 50.1, 50.5, 51, 36/54, 72 R, 132, 136, 3 A, 71

[56] References Cited

U.S. PATENT DOCUMENTS

| | | | |
|---|---|---|---|
| 1,599,229 | 9/1926 | Given | 36/54 |
| 2,651,854 | 9/1953 | Taber et al. | 36/3 A |
| 4,282,657 | 8/1981 | Antonious | 36/50.1 |
| 4,451,996 | 6/1984 | Norton | 36/71 |
| 4,676,011 | 6/1987 | O'Rourke et al. | 36/50.1 |
| 4,726,126 | 2/1988 | Bernhard . | |
| 4,727,660 | 3/1988 | Bernhard . | |
| 4,777,740 | 10/1988 | Akagi | 36/55 |
| 4,942,678 | 7/1990 | Gumbert | 36/102 |
| 4,979,317 | 12/1990 | Fukuoka | 36/3 A |
| 5,117,567 | 6/1992 | Berger | 36/54 |
| 5,177,882 | 1/1993 | Berger | 36/54 |
| 5,177,882 | 1/1993 | Berger | 36/54 |

FOREIGN PATENT DOCUMENTS 7030832 4/1971 Fed. Rep. of Germany .

*Primary Examiner*—Paul T. Sewell
*Assistant Examiner*—Marie Denise Patterson
*Attorney, Agent, or Firm*—Sixbey, Friedman, Leedom & Ferguson

[57] ABSTRACT

A shoe, especially a sport, leisure or rehabilitation shoe, with an upper that is at least partially formed of an elastically flexible material, a central closure attached on an instep cover in an area of the wearer's instep, and with a wire-like tightening element that is coupled with the central closure and runs from the central closure down toward a toe end of the upper and then back up to the central closure, the tightening element passing back and forth between guide elements on the instep cover and on side parts of the upper at each of opposite sides of the throat area. In accordance with preferred embodiments, a projecting sheet-shaped tab is molded to the instep cover, the tab being securely connected at an instep area of the shoe, and the instep cover being folded around a hinge-like connection of the tab on the instep area to be covered. As a result, the instep cover is movably attached to the shoe upper in a simple way. Furthermore, this instep cover is suitable, especially, for shoes with a supporting strap and tensioning strip attached on a shoe upper part which is formed entirely or partially of a volume-compressible, preferably of closed-pore, foam.

27 Claims, 2 Drawing Sheets

SHOE WITH A CENTRAL CLOSURE

BACKGROUND OF THE INVENTION

This invention relates to a shoe, especially a sport, leisure or rehabilitation shoe, with an upper that is at least partially formed of an elastically flexible material, a central closure attached on an instep cover in an area of the wearer's instep, and with a wire-like tightening element that is coupled with the central closure and runs from the central closure down toward a toe end of the upper and then back up to the central closure, the tightening element passing back and forth between guide elements on the instep cover and on side parts of the upper at each of opposite sides of the throat area.

Such a shoe is known from U.S. Pat. No. 5,177,882. In this shoe, tensioning strips, designed as individual elements, are each attached to the side part of the shoe upper material. On their upper ends, the supporting straps have locking elements, which lock with counterlocking elements when their ends are inserted into a slot-like opening of the tensioning strips. This arrangement and configuration of the instep supports and straps has proven itself well in shoes with a central closure attached in the instep area.

SUMMARY OF THE INVENTION

A primary object of this invention is to further develop a shoe of the above-mentioned type so that it is produced efficiently and pressure points in the area of the shoe upper material, especially in the instep and strap area, can be reliably avoided even when the shoe is tightly closed.

This object and others are achieved in accordance with a preferred embodiment of the invention in which a projecting sheet-shaped tab is molded onto the instep cover, the tab being securely connected with a tongue of the shoe. The instep cover is folded around a hinge-like connection of the tab on the instep area to be covered.

The invention makes it possible for the instep cover to be movably attached to the shoe upper in a simple way, and for the attachment position to be predetermined, but nevertheless, if necessary, still be changed individually. This type of instep cover is suitable, especially, for shoes with a supporting strap-tensioning strip attached on a shoe upper part which is formed entirely or partially of a volume-compressible, preferably of closed-pore, foam. The production of the instep cover as a molded part assures a very efficient production and a simple assembly of this molded part.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 6:
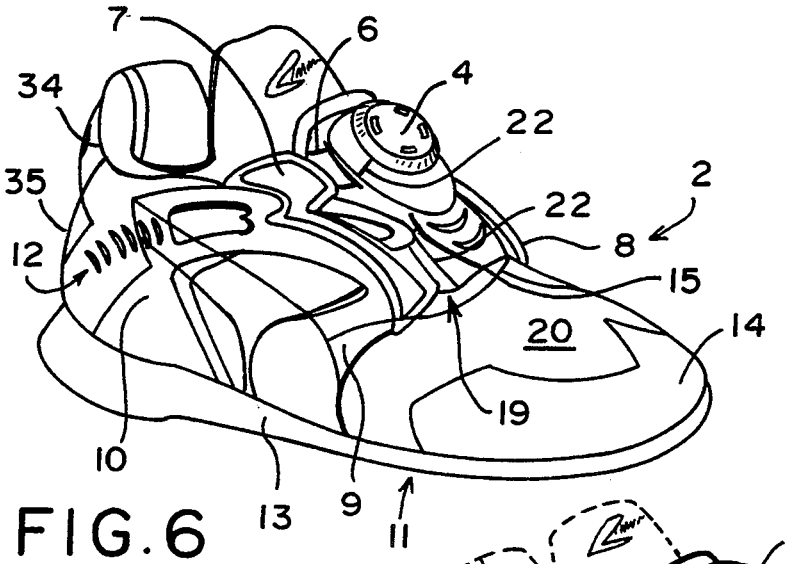
FIG. 6 is a perspective side view of a shoe in accordance with the present invention.
Figure 7:
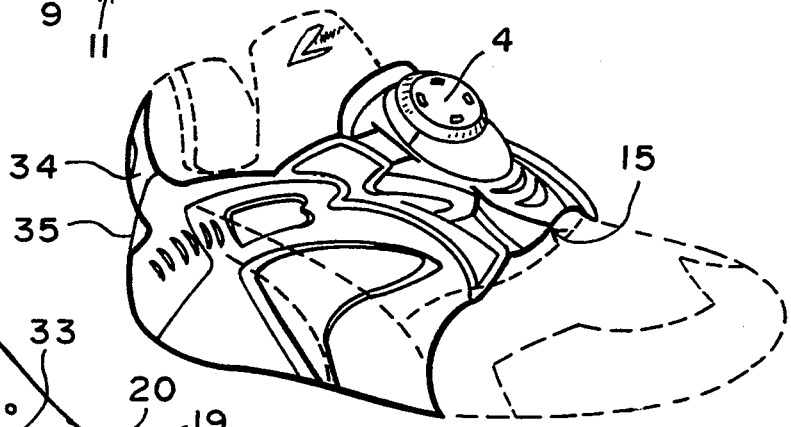
FIG. 7 shows the closure assembly of a shoe according to FIG. 6 with the shoe upper indicated with broken lines.

In FIGS. 1 to 5, an instep cover, consisting of a single relatively thin shell-like part, is designated 1. Part 1 is made of a flexible plastic and has a shape (FIG. 5) that is matched to the instep shape of shoe 2 (FIG. 6). A central closure 4, especially a central rotary closure, optionally with a quick release device (such as that disclosed in the above-noted U.S. Pat. No. 5,177,882, which is hereby incorporated by reference), is mounted in a recess 3 of the shell-like part 1. For this purpose, openings 5 are provided in which central closure 4 can be locked, for example, with counterlocking elements designed as hooks that can be guided elastically into the openings 5 and then engage behind an edge of recess 3.

A wire-like tightening element 6 (FIG. 6) is coupled with central closure 4. Tightening element 6 runs from central closure 4, down toward a toe end 14 of the upper 20 and then back up to the central closure 4, the tightening element 4 passing back and forth between guide elements on the instep cover 1 and on each of opposite sides of the upper 20. In doing so, the tightening element may travel down one side of the shoe going back-and-forth between guide elements concealed in a tensioning strip 7 and guide elements of instep cover 1, then crossing over the instep cover to a guide element of a tensioning strip 8 on the other side of the shoe, and then traveling back-and-forth between guide elements of the tensioning strip 8 and instep cover 1 to the central closure. Alternatively, a figure-8 type of path can be followed from the central closure with the tightening element 6 crossing over the instep at a central area thereof and being alternately guided from over a guide element of one of the tensioning strips 7, 8 to a guide element of the instep cover and then to a guide element of the other of the tensioning strips 7, 8. In either case, the path of the tightening element acts to pull the tensioning strips 7, 8 toward the instep cover 1 during the closing process, in a manner comparable to that shown and described in the above-referenced U.S. Pat. No. 5,177,882.

A front supporting strap 9 and a rear supporting strap 10 are attached to tensioning strips 7, 8 or can be coupled with these tensioning strips 7, 8. Front strap 9 extends up into the sole area in the area of or behind metatarsophalangeal joints 11. Rear strap 10 extends backward to heel 12 and encompasses the latter preferably also partly towards the back, where strap 10 then slopes down to sole 13. The details of the construction of the tensioning strips and supporting straps, including the manner in which they are formed or attached together into a unit, per se, form no part of this invention and are disclosed in detail in commonly-owned, copending U.S. patent application Ser. No. 08/113,661.

According to the invention, a sheet-shaped tab 16 is molded onto an edge of the instep cover 1 via a thin hinge-like connection 17, especially on front edge 15 of instep cover 1 facing toe end 14. Tab 16 is attached, for example, sewn and/or glued, with its top side 18 facing down onto the tongue or instep 19 of shoe upper part 20, approximately in the area of the wearer's metatarsophalangeal joints 11. Then, instep cover 1 is folded backward about the hinge-like connection 17 so as to, then, lie in the correct position on instep 19. Connection 17, thus, functions as a type of hinge, with which instep cover 1 is connected with the shoe but, nevertheless, can still be slightly repositioned so that it can be brought into an optimized position. For easy pivotability, and optionally, for position correction, connection 17 is narrower than the width 21 of the tab 16 and/or is thinner than the thickness of tab 16. As a result, instep cover 1 is not only sufficiently movable lengthwise, but also movable laterally to an increased extent.

In areas in which openings 22 are provided for the tightening element 6 to exit to the guide elements of tensioning strips 7, 8, the instep cover 1 has flexible tab-like supports 23, 24, which laterally project downward, and on which tensioning strips 7, 8 are supported. As a result, an advantageous pressure distribution on the tongue or on the lateral instep area is assured in the locked state and pressure points reliably avoided. In this way, supports 23, at least in the area of rear strap 10, are designed long enough so that they engage under respective rear strap 10 to a specific length of about 1 to 3 cm. As a result, the locking pressure produced by strap 10 is also more uniformly distributed. Preferably, the path, i.e., the curvature or the radius of the supports 23, 24, is also matched to the shape of the instep or the foot or shoe shape.

The instep cover 1 has guide elements 26 projecting toward instep 19 (FIGS. 8 & 9), advantageously on underside 25, in the area of slots 22. These guide elements 26 provide better guidance for tightening element 6 in the area of instep cover 1. The guide elements 26, in the case of the illustrated embodiment, are in the form of relatively thin pins.

Further, stiffening elements and/or spacer elements 27 (FIGS. 2 & 4) running on the underside 25 of the insert cover, especially crosswise to the longitudinal axis of the shoe, are molded on in the form of crosswise ribs. Advantageously, such crosswise fibs, above all, are found below recess 3, and they can extend over the transition area between supports 23, being interrupted by a groove 28 in the transition area between recess 3 and each support 23 (FIG. 2).

Figure 1:
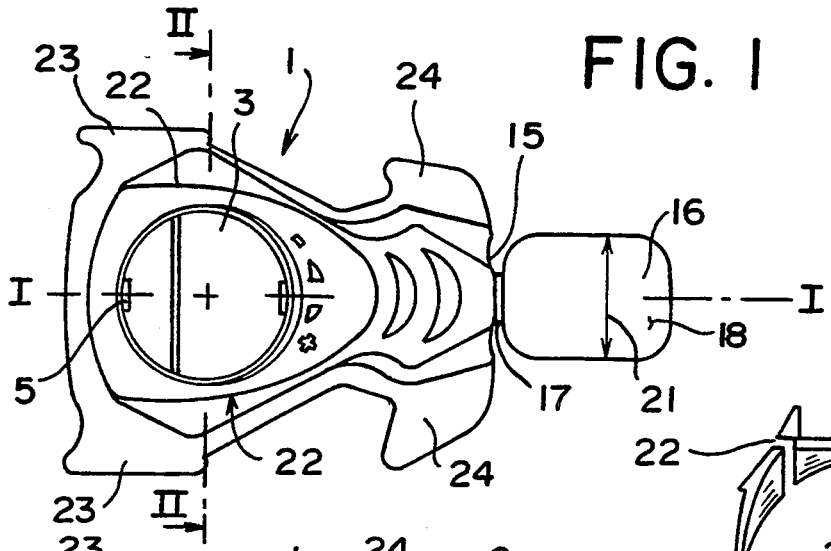
FIG. 1 is a top view of an instep cover according to the invention.
Figure 5:
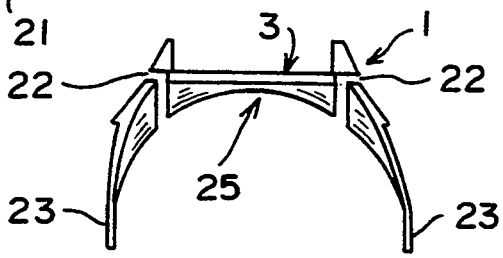
FIG. 5 is a transverse cross-sectional view of the instep cover taken along line II—II of FIG. 1.
Figure 2:
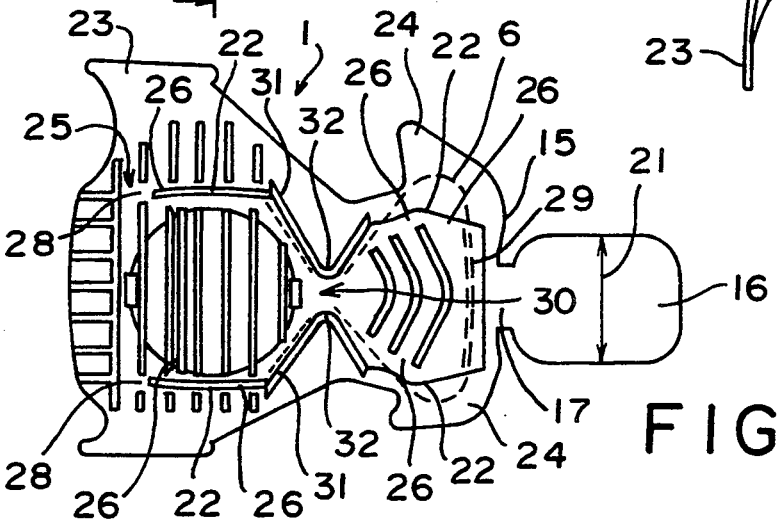
FIG. 2 is a bottom view of the instep cover according to FIG. 1.
Figure 3:
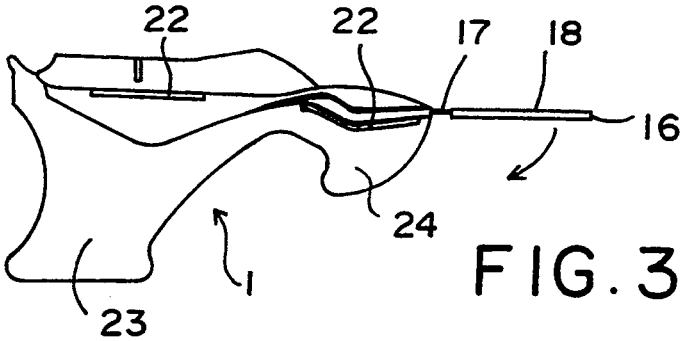
FIG. 3 is a side view of the instep cover according to FIGS. 1 and 2.
Figure 4:
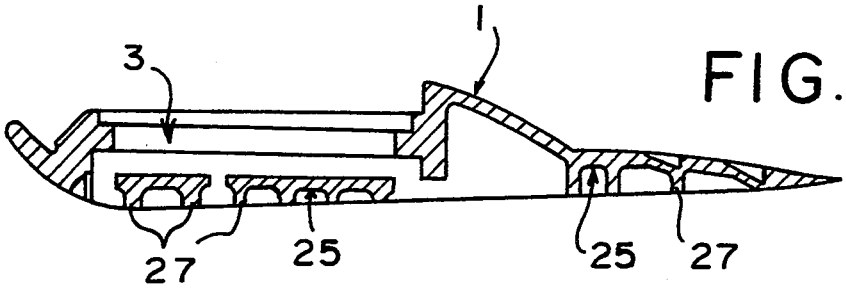
FIG. 4 is a lengthwise cross-sectional view of the instep cover taken along line I—I of FIG. 1.

Tightening element 6 is guided under instep cover 1 in the center area as represented by the dotted line path shown in FIG. 2. In the area of a crossing point 30 of a figure-8 type path of the tightening element 6, an approximately V-shaped guide element 31 projects from underside 25 on each side of instep cover 1. The apexes 32 of the V-shaped guide elements 31 are directed towards crossing point 30, but are spaced from one another, so that tightening element 6 can slide freely between them. The front section 29 of the tightening element 6 (double-dashed line in FIG. 2) is supported on tab 16 and is, therefore, covered upwardly by the folded-back instep cover 1, and downwardly by the tab 16. Thus, section 29 is guided in a freely sliding manner. However, instead of crossing-over the instep area at point 30 from an upper/lower guide element of one tightening strip 7, 8 to a lower/upper guide element of the other tightening strip, the tightening element 6 can double-back to a guide element of the same tightening strip, passing around the respect guide element 31 instead of from one to another. In the later case, the apex 32 should be sufficiently rounded with a large enough radius of curvature to prevent pinching of the tightening element 6 and to insure that it will run freely over the apex 32.

Advantageously, stiffening elements and/or spacer elements 27 are shaped and arranged so that, in the closed state of the shoe, air exchange between shoe upper 20 and instep cover 1 is possible. As a result, a heat build-up in this area can be avoided.

For better heat conduction starting from the foot, it is especially advantageous to make shoe upper 20, in the area of instep cover 1 and in the area between supporting straps 9, 10 down to sole 13, from a volume-compressible material, such as, for example, from a closed-pore foam, preferably from chlorinated rubber, with a fabric layer provided on at least one surface, and to provide micropores through the material from the inside to the outside in this section. Such micropores can be formed, for example, by laser beam treatment. The micropore density, suitably, is about 50 to 200 micropores/$cm^2$. Thus, the shoe upper can be elastically compressed by instep cover 1 and straps 9, 10, without the heat conductive ventilation being interrupted in a disturbing way. Such ventilated shoe uppers 20 are shown in FIG. 8 and 9, and as represented therein, the compressible, ventilated material can be used for less than the entire upper 20.

Figure 8:
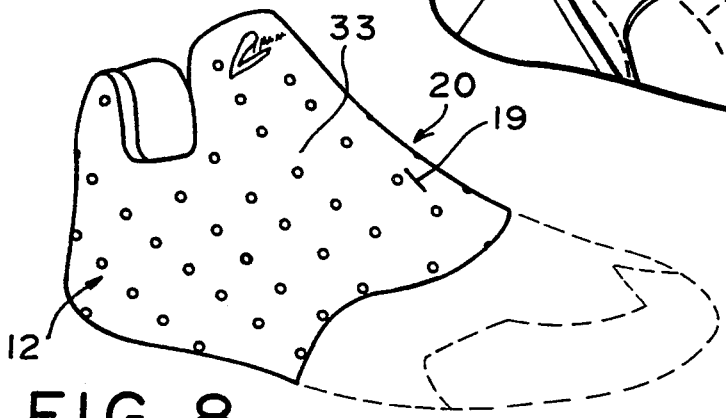
FIG. 8 is perspective view of a shoe upper part made of a volume-compressible material.
Figure 9:
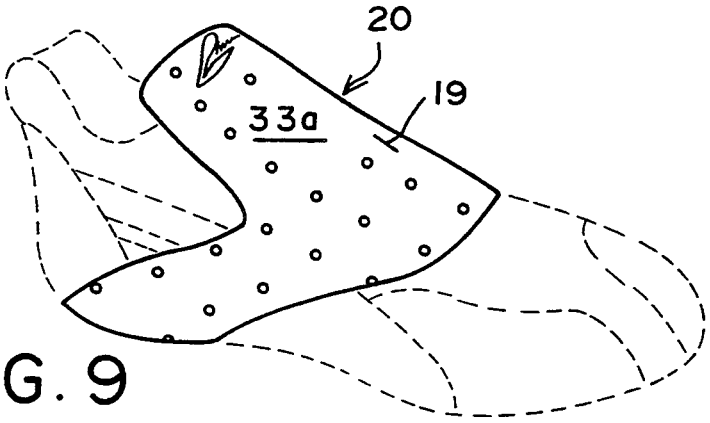
FIG. 9 is perspective view of a second configuration for a shoe upper part made of a volume-compressible material.

In FIG. 8, a part 33 is formed of the noted compressible, ventilated material, this part 33 encompassing the entire rear portion of the shoe upper 20 from the upper instep and lateral instep areas to the heel. In FIG. 9, only the tongue area and integrated lateral areas of upper 20 are formed by a part 33*a* of the compressible, ventilated material. This part 33*a* extends obliquely rearwardly to the sole and toward the heel.

In shoe upper 20 shown in FIG. 8, section 33 also extends around entire heel 12. In this case, no heel counter needs to be provided, if this section 33, easily grips the foot in a sock-like manner. Especially in this embodiment, both rear supporting straps 10, preferably, are connected with one another by an elastic, especially rubber-elastic, heel strap 34. Heel strap 34 preferably runs above the area 35 at which the wearer's heel bone would be located.

If the above-described shoe is to be used as a rehabilitation shoe with a high upper, additional supporting elements can be provided preferably in the ankle area, and special sliding areas can be provided in the outsole area, which make possible an especially good holding of the foot in the shoe and as unhindered as possible a sliding movement of such a rehabilitation shoe on the related floor surface. For this purpose, reference can be made to U.S. Pat. Nos. 4,726,126 and 4,727,660, respectively, which patents are hereby incorporated by reference.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Shoe with an upper that is at least partially formed of an elastically flexible material, an instep cover, a central closure attached on the instep cover in an area of the wearer's instep, and with a wire-like tightening element that is coupled with the central closure and runs from the central closure down toward a toe end of the upper, and then back up to the central closure, the tightening element passing back and forth between guide elements on the instep cover and on side parts of the upper at each of opposite sides of the throat area; wherein a projecting sheet-shaped fastening tab is molded on the instep cover, said tab being securely connected with the shoe in the instep area thereof; and wherein the instep cover is folded, around a hinge-like connection of the tab to the instep cover, onto the instep area into a position in which the tab extends under the instep cover as a result of said folding of the instep cover about said hinge-like connection.

2. Shoe according to claim 1, wherein the fastening tab is molded onto a front edge of the instep cover which faces toward a toe end of the shoe with the hinge-like connection formed as an integral part thereof.

3. Shoe according to claim 2, wherein the hinge-like connection is narrower than the width of the tab.

4. Shoe according to claim 3, wherein the hinge-like connection is thinner than the thickness of the tab.

5. Shoe according to claim 2, wherein the hinge-like connection is thinner than the thickness of the tab.

6. Shoe, according to claim 1, wherein the instep cover comprises a single molded part having a recess for receiving the central closure; wherein the central closure is provided with counterlocking elements; wherein locking elements are provided in the recess with which the counterlocking elements provided on the central closure are engageable.

7. Shoe according to claim 6, wherein the guide elements on the side parts of the upper are provided on tensioning strips, said tensioning strips being attached to supporting straps which run over the upper to at least an edge area of a sole of the shoe; wherein the instep cover is formed of a flexible plastic; and wherein said instep cover has thin, flat lateral supports which project laterally downward from the vicinity of said recess, at least in areas in which the tightening element runs from the central closure toward a respective guide element on the upper, said tensioning strips being supported on said supports.

8. Shoe according to claim 7, wherein a front supporting strap and a rear supporting strap are attached to each tensioning strip and a said lateral support is provided at least in the area of rear strap and extends thereunder.

9. Shoe according to claim 7, wherein the underside of the instep cover, including said lateral supports, has a shape which conforms, at least approximately, to the shape of the instep of the shoe.

10. Shoe according to claim 7, wherein the instep cover has a hollow recessed construction and comprises slots for passage of the tightening element therethrough and guide elements for guiding the tightening element on an underside thereof at least in an area of said slots for the tightening element, said guide elements of the instep cover projecting toward the instep of the shoe.

11. Shoe according to claim 10, wherein said guide elements comprise guide pins.

12. Shoe according to claim 10, wherein rib-shaped elements are molded on the underside of the instep cover projecting toward the instep.

13. Shoe according to claim 2, wherein said fastening tab extends into an area of at least forwardmost of the guide elements on the side parts of the upper, said fastening tab providing a support surface for at least one section of the tightening element which runs across the throat area of the shoe below the instep cover.

14. Shoe according to claim 1, wherein the tightening element crosses under the instep cover.

15. Shoe according to claim 14, wherein the guide elements on the instep cover comprise approximately V-shaped guide elements provided on an underside of the instep cover at an area at which portions of the tightening element cross over each other traveling from one side part of the upper to the opposite side part thereof, said V-shaped guides having apexes which are spaced at a distance from one another and are aligned with a cross-over point of the tightening element.

16. Shoe according to claim 6, wherein stiffening elements are arranged running crosswise to a lengthwise direction of the shoe under the recess for the central closure.

17. Shoe according to claim 16, wherein the guide elements on the side parts of the upper are provided on tensioning strips, said tensioning strips being attached to supporting straps which run over the upper to at least an edge area of a sole of the shoe; wherein the instep cover is formed of a flexible plastic; wherein said instep cover has thin, flat lateral supports which project laterally downward from the vicinity of said recess, at least in areas in which the tightening element runs from the central closure toward a respective guide element on the upper, said tensioning strips being supported on said lateral supports; and wherein said stiffening elements extend to lateral supports.

18. Shoe according to claim 16, wherein the stiffening elements are interrupted by a groove in a transition area between the recess and each lateral support.

19. Shoe according to claim 16, wherein the stiffening elements form a means for enabling an air exchange between the instep cover and the shoe upper when the shoe is closed.

20. Shoe according to claim 1, wherein the guide elements on the side parts of the upper are provided on tensioning strips, said tensioning strips being attached to supporting straps which run over the upper to at least an edge area of a sole of the shoe; and wherein a portion of the shoe upper at least in proximity to the instep cover between the supporting straps is made of a volume-compressible material which has a layer of fabric at least on an outer side thereof.

21. Shoe according to claim 20, wherein said portion of the shoe upper made of a volume-compressible material also extends under said supporting straps and to the sole.

22. Shoe according to claim 21, wherein said volume-compressible material is formed of a closed-cell foam and encompasses a heel portion of the upper; and wherein said supporting straps include a rear strap on each side of the upper which extends to the heel portion, partly encompassing the heel in a rearward direction and sloping down to the sole.

23. Shoe according to claim 22, wherein the rear strap on one side part of the upper is connected with the rear strap on the other side of the upper by a heel strap.

24. Shoe according to claim 23, wherein the heel strap runs at a height sufficient to extend above a wearer's heel bone.

25. Shoe according to claim 24, wherein the heel strap is made of a rubber-elastic material.

26. Shoe according to claim 22, wherein at least the part of shoe upper material made of foam has micropores going completely through it.

27. Shoe according to claim 26, wherein approximately 50 to 200 micropores/$cm^2$ are present.

* * * * *